US012024754B2

(12) United States Patent
Dong et al.

(10) Patent No.: US 12,024,754 B2
(45) Date of Patent: Jul. 2, 2024

(54) METHOD FOR MANUFACTURING A LOW-CARBON NITROGEN-CONTAINING AUSTENITIC STAINLESS STEEL BAR

(71) Applicant: DAYE SPECIAL STEEL CO., LTD., Hubei (CN)

(72) Inventors: Xiaoliang Dong, Hubei (CN); Xiuli Zhang, Hubei (CN); Lixin Zhou, Hubei (CN); Yinghua Lei, Hubei (CN); Xianhua Wang, Hubei (CN); Guangpeng Xu, Hubei (CN); Peng Xu, Hubei (CN); Guoyang Sun, Hubei (CN); Zaoyu Li, Hubei (CN); Jun Zhang, Hubei (CN); Dong Ruan, Hubei (CN)

(73) Assignee: DAYE SPECIAL STEEL CO., LTD., Hubei (CN)

( * ) Notice: Subject to any disclaimer, the term of this patent is extended or adjusted under 35 U.S.C. 154(b) by 0 days.

(21) Appl. No.: 18/247,564

(22) PCT Filed: Dec. 8, 2022

(86) PCT No.: PCT/CN2022/137667
§ 371 (c)(1),
(2) Date: Mar. 31, 2023

(87) PCT Pub. No.: WO2023/098919
PCT Pub. Date: Jun. 8, 2023

(65) Prior Publication Data

US 2024/0035110 A1 Feb. 1, 2024

(30) Foreign Application Priority Data

Dec. 16, 2021 (CN) ..... 202111541505.5

(51) Int. Cl.

| | |
|---|---|
| ***C21D 9/52*** | (2006.01) |
| ***C21C 5/00*** | (2006.01) |
| ***C21C 5/52*** | (2006.01) |
| ***C21D 1/84*** | (2006.01) |
| ***C21D 6/00*** | (2006.01) |
| ***C21D 8/10*** | (2006.01) |
| ***C22C 33/04*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/48*** | (2006.01) |
| ***C22C 38/52*** | (2006.01) |
| ***C22C 38/54*** | (2006.01) |

(52) U.S. Cl.
CPC ..... *C21D 9/525* (2013.01); *C21C 5/005* (2013.01); *C21C 5/52* (2013.01); *C21D 1/84* (2013.01); *C21D 6/004* (2013.01); *C21D 6/005* (2013.01); *C21D 6/007* (2013.01); *C21D 6/008* (2013.01); *C21D 8/105* (2013.01); *C22C 33/04* (2013.01); *C22C 38/001* (2013.01); *C22C 38/002* (2013.01); *C22C 38/02* (2013.01); *C22C 38/04* (2013.01); *C22C 38/42* (2013.01); *C22C 38/48* (2013.01); *C22C 38/52* (2013.01); *C22C 38/54* (2013.01); *C21D 2211/001* (2013.01)

(58) Field of Classification Search
CPC ..... C21D 9/525
See application file for complete search history.

(56) References Cited

U.S. PATENT DOCUMENTS

2023/0175093 A1* 6/2023 Xu ..... C22C 33/006 148/546

FOREIGN PATENT DOCUMENTS

| | | | |
|---|---|---|---|
| CN | 104399854 | A | 3/2015 |
| CN | 105088094 | B | 4/2018 |
| CN | 105177264 | B | 6/2018 |
| CN | 110684927 | A | 1/2020 |
| CN | 112662935 | A | 4/2021 |
| CN | 114250402 | A | 3/2022 |
| WO | 2021223660 | A1 | 11/2021 |

OTHER PUBLICATIONS

English machine translation of CN 105088094 A of Zhu (Year: 2015).*
First Office Action in CN202111541505.5, dated Apr. 19, 2022 (with translation).
International Search Report issued in International Application No. PCT/CN2022/137667, dated Mar. 1, 2023.
Written Opinion issued in International Application No. PCT/CN2022/137667, dated Mar. 1, 2023.

* cited by examiner (Continued)

*Primary Examiner* — Jophy S. Koshy
(74) *Attorney, Agent, or Firm* — United IP Counselors, LLC

(57) ABSTRACT

A method for manufacturing a low-carbon nitrogen-containing austenitic stainless steel bar sequentially includes smelting, electroslag remelting, and forging. During electroslag remelting, the steel ingot obtained in the smelting process is used as an electrode bar of the electroslag furnace and is remelted with specific slag and crystallized. The specific slag comprises $CaF_2$ (65-70%), $Al_2O_3$ (15-20%), CaO (5-10%) and MgO (2-5%) in percentage by weight. Specific forging methods, including upsetting-and-drawing and radial forging, are used. In upsetting-and-drawing, the pass deformation is less than 35%, the pass reduction is 50-80 mm, the pass heating temperature is 1130-1150° C., and the pass deformation method is ellipse-ellipse-circle. The method can obtain the low-carbon high-strength nitrogen-containing austenitic stainless steel with uniformly distributed chemical composition, high purity and high strength.

15 Claims, No Drawings

METHOD FOR MANUFACTURING A LOW-CARBON NITROGEN-CONTAINING AUSTENITIC STAINLESS STEEL BAR

FIELD OF THE INVENTION

The invention relates to a method for manufacturing a metal material, in particular to a method for manufacturing a low-carbon high-strength nitrogen-containing austenitic stainless steel bar.

BACKGROUND

With the rapid development of the current industrialization, the requirements on metal materials are higher and higher, especially in some special environments, such as nuclear power, boilers, military industry and other fields, which often involve the need for metal materials with corrosion resistance, high and low temperature resistance and high strength. Among current common steel materials, only austenitic stainless steel can meet the use requirements, but the austenitic stainless steel has more stringent requirements on composition and performance criteria.

The current international and domestic standard for the implementation of this type of austenitic stainless steel is RCCM M3306, compiled by the French Association for the Design and Donstruction Rules of Mechanical Equipment of pressurized water reactor nuclear island, which requires C: less than or equal to 0.035%, Si: less than or equal to 1.00%, Mn: less than or equal to 2.00%, S: less than or equal to 0.015%, P: less than or equal to 0.030%, Cr: 18.50-20.00%, Ni: 9.00-10.00%, Cu: less than or equal to 1.00%, Co: less than or equal to 0.06%, N: less than or equal to 0.080%, B: less than or equal to 0.0018%, and Nb+Ta: less than or equal to 0.15%. In order to ensure the corrosion resistance of the material, the content of carbon and nitrogen elements is limited in the standard: C: less than or equal to 0.035%, and N: less than or equal to 0.08%. At the same time, the standard requires that the properties for this type of austenitic stainless steel are that: the tensile strength at the high temperature of 350° C. is more than or equal to 394 MPa, the yield strength at the high temperature of 350° C. is more than or equal to 125 MPa, the tensile strength at the room temperature is more than or equal to 520 MPa, and the yield strength at the room temperature is more than or equal to 210 MPa.

However, for low-carbon high-strength nitrogen-containing austenitic stainless steel, the main strengthening elements for improving the strength thereof are carbon and nitrogen elements, and when the contents of the carbon and nitrogen elements are high, the strength of the steel is high, and vice versa. However, when the contents of carbon and nitrogen elements are high, the corrosion resistance of steel is lowered. In the national standard GB/T1220-2007, the requirement of nitrogen element in the similar low-carbon high-strength nitrogen-containing austenitic stainless steel material is 0.10-0.16%, so that the stainless steel can easily realize the high strength of the similar steel in the RCCM 3306 standard, but the corrosion resistance required by the standard is difficult to meet due to the high nitrogen content.

However, if the content of nitrogen element in the national standard GB/T1220-2007 is reduced, the steel can hardly reach the high strength of the steel of the same type in the RCCM M3306 standard. Therefore, compared with the chemical composition requirements of the steel in the RCCM 3306 standard, the production of low-carbon high-strength nitrogen-containing austenitic stainless steel is more difficult.

At present, the situation that the strength of the produced austenitic stainless steel does not meet the standard requirement frequently occurs in the production process of domestic enterprises, and the yield in the production process is low, resulting that the austenitic stainless steel still needs to be imported from France.

Therefore, a manufacturing method capable of manufacturing the low-carbon high-strength nitrogen-containing austenitic stainless steel having more stable performance is required.

SUMMARY

The invention aims to overcome the problems in the prior art and provide a method for manufacturing a low-carbon nitrogen-containing austenitic stainless steel bar, and the mechanical property of the stainless steel bar manufactured by the method meets the requirement of the mechanical property of the austenitic stainless steel bar in the RCCM 3306 standard, so that the technical barrier is broken through, the self-production of the low-carbon high-strength nitrogen-containing austenitic stainless steel bar is realized, without relying on the import of such stainless steel bar from abroad.

After in-depth research, the inventor of the invention finds that after the steel is controlled within the range of specific composition components, the remelting and crystallizing was performed with the steel ingot which is used as an electrode bar for electroslag remelting, and the remelting process is carried out by specific slag, resulting in that the uniform distribution of chemical composition in the steel and the higher purity of the steel can be better controlled; and then the steel ingot is forged into a material by a specific forging method, so that the steel with uniform distribution of chemical composition and tissues, high purity and qualified strength is obtained. Therefore, the present invention provides a method for manufacturing the low-carbon high-strength nitrogen-containing austenitic stainless steel bar.

In order to achieve the purpose, the invention adopts the following technical scheme.

A method for manufacturing a low-carbon nitrogen-containing austenitic stainless steel bar sequentially comprises the following steps of: smelting, electroslag remelting and forging; in the electroslag remelting process (step), taking the steel ingot obtained in the smelting process as an electrode bar of an electroslag furnace, remelting with specific slag and crystallizing; in the forging process, forging the crystallized steel ingot into a material by a specific forging method;

The specific slag comprises $CaF_2$, $Al_2O_3$, CaO and MgO, according to the weight percentage, the contents of the $CaF_2$, the $Al_2O_3$, the CaO and the MgO are (65-70%), (15-20%), (5-10%), and (2-5%) in sequence; The specific forging method comprises upsetting-and-drawing and radial forging, wherein the upsetting-and-drawing comprises: a pass deformation is less than 35% (e.g. 28%, 30%, 32%, 33%, and 34%), a pass reduction is 50-80 mm (e.g. 55 mm, 60 mm, 70 mm, and 75 mm), a pass heating temperature is 1130-1150° C. (e.g. 1135° C., 1140° C., and 1145° C.), and a pass deformation method is ellipse-ellipse-circle. The pass heating temperature refers to the temperature of the furnace for reheating after the deformation of each pass is finished.

In the invention, the upsetting-and-drawing comprises upsetting and drawing, and the steel ingot generally has the oval shape gradually reduced firstly and finally becomes round when being forged and drawn. The rolling reduction is a single rolling height of a press, and the deformation is the area change of the steel before and after the deforming.

In the above manufacturing method, as a preferred embodiment, according to the percentage by weight, the contents of $CaF_2$, $Al_2O_3$, CaO and MgO are (65%-68%), (18%-20%), (5%-10%), (3%-5%) in sequence, and more preferably the $CaF_2$, $Al_2O_3$, CaO and MgO are 65%, 20%, 10% and 5% in sequence.

In a conventional stainless steel forging process, pass deformation is generally selected to be 40-60% in order to improve the production efficiency of steel; the heating temperature of each pass is generally 1160-1180° C., and the deformation method of the pass is square-ellipse-circle.

Compared with the conventional stainless steel forging process, the pass deformation used in the present invention is less than 35% so as to ensure uniform transformation of an as-cast structure of a steel ingot in the forging process; the pass reduction of 50-80 mm is adopted to ensure uniform deformation of the steel ingot in the forging process and avoid local tissue (structure) disorder caused by overlarge (excessive) reduction; the pass heating temperature is 1130-1150° C. (such as 1135° C., 1140° C. and 1145° C.) so as to ensure that the material can obtain fine and dispersed tissues. In addition, the invention adopts an ellipse-ellipse-circle pass deformation method (mode), and aims to avoid square edges and corners of the steel, which leads to abnormal steel structure due to too fast temperature reduction of the edges and corners.

In the above manufacturing method, as a preferred embodiment, the steelmaking raw materials are mixed according to a method that the steel ingot obtained after smelting or the finally obtained stainless steel bar has specific composition components; the specific composition components comprise: C: 0.020-0.030%, Si: 0.3-0.6%, Mn: 1.3-1.8%, S: less than or equal to 0.002%, P: less than or equal to 0.015%, Cr: 19.20 to 19.70%, Ni: 9.20-9.80%, Cu: less than or equal to 1.00%, Co: less than or equal to 0.06%, N: 0.065-0.075%, B: less than or equal to 0.0018%, and Nb+Ta: less than or equal to 0.15% in percentage by weight.

Preferably, the specific composition components comprises: c: 0.025%, Si: 0.5%, Mn: 1.45%, S: less than or equal to 0.002%, P: less than or equal to 0.015%, Cr: 19.5%, Ni: 9.7%, Cu: less than or equal to 1.00%, Co: less than or equal to 0.06%, N: 0.07%, B: less than or equal to 0.0018%, and Nb+Ta: less than or equal to 0.15% in percentage by weight.

In the invention, on the basis that the content of C is 0.020-0.030%, the reasonably designed contents of Cr, Ni and N are adopted to ensure that the elements can form more carbides, intermetallic compounds and precipitated phases in steel, and the strength of the steel can be effectively improved in the steel.

In the above manufacturing method, as a preferred embodiment, the steelmaking raw materials includes low-carbon ferrochrome, metallic nickel, electrolytic manganese, ferrosilicon, ferrochrome nitride, and scrap steel. In the present invention, the low carbon ferrochrome, metallic nickel, electrolytic manganese, ferrosilicon, ferrochrome nitride, scrap steel, etc. can adopt various metals conventionally used for refining 304 series steel in the art.

In the above-described manufacturing method, as a preferred embodiment, the melting step includes a melting treatment, a refining treatment, a vacuum degassing treatment and a casting molding in this order.

In the above manufacturing method, as a preferred embodiment, before the electroslag remelting process, the steel ingot obtained in the smelting process is first subjected to a cutting treatment and a surface polishing treatment, and then used as an electrode bar for electroslag remelting; the cutting treatment is used for cutting off the part with defective feeding; the surface polishing treatment is used to obtain electrode bars with good surface quality. After the cutting treatment and the surface polishing treatment, the remelted steel ingot can be ensured to have uniform chemical composition and good surface quality, so that the steel with better surface quality, high purity, uniform tissue and high strength is obtained.

In the above manufacturing method, as a preferred embodiment, in the electroslag remelting process, the current for electroslag remelting is 11 to 13 KA (e.g., 11.5 KA, 12.0 KA and 12.5 KA).

In the invention, in the electroslag remelting process, the female electrode is rapidly melted due to overlarge current, so that a metal molten pool becomes deep, and the core of the steel ingot obtained after crystallizing has a serious segregation structure and poor purity. The too low current can lead to slower melting of the female electrode and further to shallow metal molten pool, and the edge of the steel ingot obtained after crystallizing can have serious segregation structure and poor purity.

According to the invention, in the electroslag remelting process, remelting and crystallizing performed with a mixed slag (specific slag) of $CaF_2$, $Al_2O_3$, CaO and MgO can effectively improve the purity of steel, wherein the components of $CaF_2$, $Al_2O_3$, CaO and MgO in percentage by weight are (65%-70%), (15%-20%), (5%-10%) and (2%-5%) in sequence, preferably 65%, 20%, 10% and 5% in sequence. Here, $CaF_2$ can reduce the melting point, viscosity and surface tension of slag, improve the fluidity of the molten slag and effectively eliminate non-metallic inclusions in steel; $Al_2O_3$ can reduce the conductivity of the molten slag and achieve the effect of energy conservation and consumption reduction, but the excessive addition will increase the viscosity of the molten slag; CaO can improve the alkalinity of the molten slag, and the effective desulfurization capability ensures that the molten steel is purer; MgO can form a slag film on the surface of the molten slag, prevent the secondary oxidation of molten steel outwards, and can reduce the heat loss inwards, but adding too much MgO will increase the viscosity of the molten slag. Therefore, the four-element slag system composed of the four substances can obtain steel with higher purity and also reduce energy consumption.

In the invention, if the selected slag and current are not suitable, the defects such as slag entrapment and slag coating, low purity of molten steel, serious segregation of steel, poor surface quality of steel ingots will occur. The invention adopts a specific slag ratio of $CaF_2$, $Al_2O_3$, CaO and MgO in mass ratio (65%-70%), (15%-20%), (5%-10%), and (2%-5%) in sequence, preferably, 65%, 20%, 10% and 5% in sequence, and the remelted current of 11-13 KA, preferably 11 KA, which can ensure the stable melting of the electrode bar, and can also obtain a steel ingot with high purity, uniform structure and composition and good the surface.

In the above manufacturing method, as a preferred embodiment, in order to obtain steel having a high surface quality, 1 to 10 wt %, preferably 1 to 8 wt % (for example, 2 wt %, 3 wt %, 5 wt %, 6 wt %, and 7 wt %) of the electrode bar is used for feeding the steel ingot after crystallizing in the electroslag remelting process. That is, when molten steel is dropped into the crystallizer for crystallizing, shrinkage cavities will exist on the surface of the steel ingot due to the action of the surface tension of the molten steel. In order to avoid the problem that the quality of the processing plasticity of the steel ingot is affected due to the poor surface quality of the steel obtained after forging caused by the large shrinkage cavities formed in the steel ingot, it is preferable that 1 to 10 wt %, and more preferably 1 to 8 wt % of an electrode bar is used to fill up the shrinkage cavities on the surface of the steel ingot formed after crystallizing at the later stage of crystallizing.

In the above manufacturing method, as a preferred embodiment, the steel ingot obtained by electroslag remelting is demolded and cooled to room temperature to obtain a low-carbon nitrogen-containing austenitic stainless steel blank.

The low-carbon nitrogen-containing austenitic stainless steel blank prepared by the technical scheme of the invention has the advantages of uniform distribution of chemical composition, high purity and no segregation defect, and can be used for manufacturing a low-carbon high-strength nitrogen-containing austenitic stainless steel bar, but the method for manufacturing the low-carbon high-strength nitrogen-containing austenitic stainless steel bar needs to meet special requirements.

In the above manufacturing method, as a preferred embodiment, in the forging process, the low-carbon nitrogen-containing austenitic stainless steel blank obtained by electroslag remelting are subject to soaking treatment before upsetting-and-drawing. The soaking treatment includes heating up to 1130-1150° C. (e.g., 1135° C., 1140° C. and 1145° C.) at a heating speed of 1 to 10° C./min (e.g., 2° C./min, 3° C./min, 5° C./min, 7° C./min, 8° C./min and 9° C./min), and then preserving the heat for 3 to 5 hours at the temperature (e.g., 3.5 hours, 4.0 hours and 4.5 hours).

In the above manufacturing method, as a preferred embodiment, in the forging process, the condition of the upsetting-and-drawing includes upsetting and drawing by the specific forging method, wherein initial forging temperature is more than or equal to 1000° C. (for example, 1050° C., 1100° C., 1110° C., 1120° C.), final forging temperature is more than or equal to 800° C. (for example, 850° C., 900° C., 950° C., 1000° C.), the upsetting-and-drawing are performed for 1 to 3 times (for example, 2 times), preferably 2 to 3 times; the time for each upsetting and drawing is 5-20 minutes (for example, 8 minutes, 10 minutes, 12 minutes, 15 minutes, 17 minutes, 19 minutes).

In the above manufacturing method, as a preferred embodiment, in the forging process, the condition of the upsetting-and-drawing includes that the upsetting-and-drawing is performed by the specific forging method, wherein the initial forging temperature is 1050 to 1100° C. (for example, 1060° C., 1070° C., 1080° C. and 1090° C.), and the final forging temperature is 800 to 900° C. (for example, 820° C., 850° C., 870° C. and 890° C.), and the time for each upsetting-and-drawing is preferably 5 to 15 minutes (for example, 7 minutes, 9 minutes, 10 minutes, 12 minutes and 14 minutes).

In the above manufacturing method, as a preferred embodiment, the specific forging method includes that the pass deformation is 30-32% (e.g. 30.5%, 31%, and 31.5%), the pass reduction is 65-75 mm (e.g. 67 mm, 70 mm, 72 mm and 74 mm), the pass heating temperature is 1130-1150° C. (e.g. 1135° C., 1140° C. and 1145° C.), and the pass deformation method is: ellipse-ellipse-circle.

In the above manufacturing method, as a preferred embodiment, the specific forging method includes: the pass deformation is 31%, the pass reduction is 70 mm, the pass heating temperature is 1140° C., and the pass deformation method is: ellipse-ellipse-circle.

In the above manufacturing method, as a preferred embodiment, in the upsetting-and-drawing of the forging process, two upsetting and two drawing (i.e., twice upsetting-and-drawing) are performed in a 4500 t press, and the second upsetting-and-drawing deformation is larger than the first deformation, so that the problem of coarse structure caused by the process of returning to furnace after the first upsetting-and-drawing can be solved, and the obtained steel material can have better grain size.

In the above manufacturing method, as a preferred embodiment, in the upsetting-and-drawing of the forging process, each upsetting-and-drawing (including upsetting and drawing) is completed, returning to the furnace for reburning is performed to reach the required initial forging temperature for the next upsetting-and-drawing. Preferably, the conditions of the returning to the furnace and the reheating (i.e., pass heating) after each upsetting-and-drawing is finished include that: the temperature is 1130-1150° C. (such as 1135° C., 1140° C. and 1145° C.), and the time is 90-120 minutes (such as 95 minutes, 100 minutes, 110 minutes and 115 minutes).

After the final upsetting-and-drawing, the heating can be carried out again by adopting the above conditions of returning to the furnace and the reheating to prepare for the next radial forging.

In the above manufacturing method, as a preferred embodiment, in the forging process, the radial forging is performed after the upsetting-and-drawing; and the radial forging conditions comprise that: the initial forging temperature is 1000-1140° C. (e.g., 1020° C., 1040° C., 1050° C., 1070° C., 1090° C., 1115° C., 1125° C., 1130° C. and 1135° C.), the final forging temperature is 800-900° C. (e.g., 820° C., 850° C., 870° C. and 890° C.), and the time is 5-20 minutes (e.g., 8 minutes, 10 minutes, 12 minutes, 15 minutes, 17 minutes and 19 minutes).

Still preferably, the conditions of the radial forging include: the initial forging temperature is 1000-1100° C. (such as 1005° C., 1010° C., 1020° C., 1040° C., 1050° C., 1070° C., 1080° C. and 1090° C.), the final forging temperature is 800-900° C. (such as 820° C., 850° C., 870° C. and 890° C.), and the time is 10-20 minutes (such as 12 minutes, 15 minutes, 17 minutes and 18 minutes).

More preferably, the radial forging is carried out on a 1600t radial forging machine, one-time forging forming is carried out, and the radial forged steel is cooled in air to obtain the low-carbon nitrogen-containing austenitic stainless steel bar.

By adopting the method of the present invention, the low-carbon nitrogen-containing austenitic stainless steel bar with a diameter of more than 200 mm can be prepared.

In the manufacturing method, as a preferable embodiment, the obtained low-carbon nitrogen-containing austenitic stainless steel bar has a tensile strength at 350° C. of more than or equal to 410 MPa, a yield strength at 350° C. of more than or equal to 140 MPa, a tensile strength at room temperature of more than or equal to 560 MPa, and a yield strength at room temperature of more than or equal to 260 MPa, the chemical composition and microstructure are uniform, and the purity of steel is high.

In the invention, the above technical characteristics can be freely combined to form a new technical scheme under the condition that they do not conflict with each other.

Compared with the prior art, the invention has the following beneficial technical effects:

1, By adopting the technical scheme of the invention, the uniform distribution of chemical composition in the steel and the higher purity of the steel can be better controlled.

2, By adopting the technical scheme of the invention, the low-carbon high-strength nitrogen-containing austenitic stainless steel with uniformly distributed chemical composition and tissues, high purity and high strength can be obtained.

DETAILED DESCRIPTION

The technical solutions in the embodiments of the present invention will be described in detail below with reference to examples of the present invention. It should be understood that the specific embodiments described herein are only used to illustrate and explain the invention and are not intended to limit the invention. Based on the embodiments in the invention, all other embodiments obtained by a person of ordinary skill in the art without any creative efforts shall fall within the protection scope of the present invention.

The invention provides a method for manufacturing a low-carbon high-strength nitrogen-containing austenitic stainless steel bar, which comprises the following steps: smelting, electroslag remelting and forging; wherein, Smelting process: steelmaking raw materials are added into an electric arc furnace, an external refining furnace and a vacuum oxygen-blowing decarburization furnace for smelting, wherein the smelting sequentially comprises melting treatment, refining treatment, first sample adjustment treatment, oxygen-blowing decarburization treatment, degassing treatment, nitrogen-blowing treatment, second sample adjustment treatment and casting molding; the steelmaking raw materials are mixed according to a way that the finally obtained steel ingot has a specific composition; and the specific composition in percentage by weight comprises: C: 0.020 to 0.030%, Si: 0.3-0.6%, Mn: 1.3-1.8%, S: less than or equal to 0.002%, P: less than or equal to 0.015%, Cr: 19.20 to 19.70%, Ni: 9.20-9.80%, Cu: less than or equal to 1.00%, Co: less than or equal to 0.06%, N: 0.065-0.075%, B: less than or equal to 0.0018%, and Nb+Ta: less than or equal to 0.15%;

Electroslag remelting process: the steel ingots obtained from the smelting process are first cut and polished, and then used as an electrode bar for electroslag remelting, remelted with specific slag and crystallized, and then the crystallized steel ingot is cooled; and the specific slag includes $CaF_2$, $Al_2O_3$, CaO and MgO, wherein the contents of the $CaF_2$, $Al_2O_3$, CaO and MgO in percentage by weight are (65%-70%), (15%-20%), (8%-10%), (2%-5%) in sequence, and the sum of the final proportions is ensure to be 100%;

Forging process: the crystallized steel ingot is cooled; and in the forging process, the crystallized steel ingot is forged into a material in a specific forging method. The specific forging comprises upsetting-and-drawing and radial forging; the upsetting-and-drawing comprising upsetting and drawing, wherein the upsetting-and-drawing comprises: the pass deformation is less than 35% (e.g. 28%, 30%, 32%, 33% and 34%), the pass reduction is 50-80 mm (e.g. 55 mm, 60 mm, 70 mm and 75 mm), the pass heating temperature is 1130-1150° C. (e.g. 1135° C., 1140° C. and 1145° C.), and the pass deformation method is: ellipse-ellipse-circle. The pass heating temperature refers to the temperature of the furnace for reheating after the deformation of each pass is finished.

In the present invention, the smelting process may adopt a conventional technical scheme in the field.

According to the present invention, as a preferred embodiment, the steelmaking raw materials includes low carbon ferrochrome, metallic nickel, electrolytic manganese, ferrosilicon, ferrochromium nitride, scrap steel, etc., and the low carbon ferrochrome, metallic nickel, electrolytic manganese, ferrosilicon, ferrochromium nitride, scrap steel, etc. may be various metals conventionally used for refining 304 series steel in the art, for example, the metallic nickel is 1 #Ni, etc.

According to the invention, as a preferred embodiment, the specific composition comprises: C: 0.025%, Si: 0.5%, Mn: 1.45%, S: less than or equal to 0.002%, P: less than or equal to 0.015%, Cr: 19.5%, Ni: 9.7%, Cu: less than or equal to 1.00%, Co: less than or equal to 0.06%, N: 0.07%, B: less than or equal to 0.0018%, and Nb+Ta: less than or equal to 0.150% in percentage by weight.

Although the steelmaking raw material can be prepared according to the above composition, in order to obtain a better quality steel ingot, it is preferable that a part of the low-carbon ferrochrome and the nitrided ferrochrome in the steelmaking raw material is reserved in the smelting treatment process as the feed for the second sample preparation treatment.

According to a preferred embodiment of the present invention, the melting treatment is a process of melting and mixing steelmaking raw materials by electrode heating, oxygen blowing, and slag adding after the steelmaking raw materials are charged into an electric arc furnace such as a vacuum arc furnace. Preferably, the tapping conditions of the melting treatment include: c is less than or equal to 0.60%, and T is more than or equal to 1630° C.

According to a preferred embodiment of the present invention, the refining treatment is to pour molten steel from an electric furnace into an external refining furnace, and reducing the molten steel in the electric arc furnace by electrode heating and slag adding treatment, preferably, adding 5 to 10 kg/t of Si—C powder, deoxidizing, and electrically burning slag for more than 10 minutes. Adjusting the slag to be proper (i.e. adjusting the slag to be white), sampling, fully analyzing, returning the sample and adjusting the components (compositions). Preferably, the tapping condition T is more than or equal to 1650° C., and the tapping components are: less than or equal to 0.80% of C, less than or equal to 0.30% of Si and less than or equal to 0.015% of S.

According to the invention, as a preferred embodiment, a vacuum oxygen decarburization treatment, degassing treatment and nitrogen blowing treatment are carried out in a vacuum oxygen decarburization furnace, which means that the molten steel in a refining furnace outside the furnace is subjected to the vacuum oxygen blowing treatment so as to remove the carbon content of the steel, and then a slag and a deoxidizing agent are added under vacuum to carry out a vacuum degassing treatment so as to remove oxides remained in the steel after the oxygen decarburization; the nitrogen blowing treatment is carried out at the bottom of the furnace after the deoxidation is finished so as to increase the nitrogen content in the steel, and finally the reserved low-carbon ferrochrome and the reserved nitrided ferrochrome are added according to chemical composition; preferably, the refining slag outside the furnace is scraped out before the molten steel enters the vacuum oxygen decarburization furnace, and the slag charge proportion of the vacuum degassing treatment is: 400 kg/furnace of lime, 50-100 kg/furnace of fluorite and 200-300 kg/furnace of pre-dissolved aluminum-calcium composite slag; the deoxidizer is Al particles, Ca—Si or Fe—Si; preferably, 1-3 kg/t of deoxidizer Al particles and 5-8 kg/t of Ca—Si or Fe—Si are added along with slag; the vacuum of vacuum degassing treatment is less than or equal to 100 Pa, and the holding time is more than or equal to 10 minutes.

According to a preferred embodiment of the present invention, the casting molding is that casting molten steel with acceptable (qualified) chemical composition obtained by vacuum degassing treatment into electrodes, preferably, argon gas is blown into the bottom of the furnace for 20 minutes before casting, and the molten steel is cast under the protection of argon gas, wherein the casting temperature is 1530-1550° C.

According to the present invention, as a preferred embodiment, a steel ingot having the composition of the present invention, particularly a steel ingot produced by the above-described production method, used as an electrode bar for electroslag remelting, is remelted and crystallized.

In the present invention, in order to obtain a steel material having a better surface quality, high purity, uniform structure and high strength, it is necessary to ensure that the chemical composition of the steel ingot after remelting are uniform and the surface quality is good, and it is preferable that the steel ingot used as the electrode bar should be first performed the cutting treatment and surface polishing treatment. The cutting treatment is used for cutting off the part with defective feeding; and the surface polishing treatment is used to obtain electrode bars with good surface quality.

According to a preferred embodiment of the present invention, in the electroslag remelting process, the steel ingot obtained by casting and shaping is used as an electrode bar of an electroslag furnace, the electrode bar will melt into molten steel in a slag under the condition of energization, and the molten steel is dripped into a crystallizer through the slag to be crystallized; preferably, the specific slag charge ratio is: $CaF_2$:65%, $Al_2O_3$:20%, CaO:10%, and MgO:5% in percentage by weight, and the current of electroslag remelting is 11 KA.

According to the present invention, in order to obtain a steel with high surface quality, preferably, 1 to 10 wt % (more preferably, 1 to 8 wt %) of the electrode bar is used for feeding the crystallized steel ingot. That is, when molten steel drops into the crystallizer for crystallizing, shrinkage cavities will exist on the surface of the steel ingot due to the action of the surface tension of the molten steel. In order to avoid the problem that the quality of the processing plasticity of the steel ingot is affected due to the poor surface quality of the steel obtained after forging caused by the large shrinkage cavities formed in the steel ingot, it is preferable that 1 to 10 wt %, more preferably 1 to 8 wt % of an electrode bar is used to fill up the shrinkage cavities on the surface of the steel ingot formed after crystallizing at the later stage of crystallizing.

The low-carbon nitrogen-containing austenitic stainless steel obtained by the manufacturing method of the invention has the advantages of uniform distribution of chemical composition, high purity and no segregation defect, and can be used for manufacturing a low-carbon high-strength nitrogen-containing austenitic stainless steel bar.

In the above manufacturing method, as a preferred embodiment, in the forging process, the specific forging method is to upset-and-draw and radially forge the steel ingot after soaking treatment. The soaking treatment is to cool and then heat the steel ingot obtained in the electroslag remelting process, which comprises: heating up to 1130-1150° C. at a heating speed of 1-10° C./min, and then preserving heat for 3-5 hours. The upsetting-and-drawing comprises upsetting and drawing.

In the above manufacturing method, as a preferred embodiment, the condition of the upsetting-and-drawing in the forging process includes that the initial forging temperature is more than or equal to 1000° C., the final forging temperature is more than or equal to 800° C., and the time of each upsetting-and-drawing is 5-20 minutes; the pass deformation is 30-32%, the pass reduction is 65-75 mm, the pass heating temperature is 1130-1150° C., and the pass deformation method is ellipse-ellipse-circle.

Preferably, the condition of upsetting-and-drawing comprises that the initial forging temperature is 1050-1100° C., the final forging temperature is 800-900° C., and the time of each upsetting-and-drawing is 5-15 minutes; the number of upsetting-and-drawing can be 1-3 times, preferably 2-3 times; more preferably, two upsetting and two drawing are carried out in a 4500t press, and the deformation of the second upsetting-drawing is larger than that of the first one, so that the problem of coarse structure caused by the process of returning to furnace after the first upsetting-drawing can be solved, and thus the obtained steel has better grain size.

Wherein, every time upsetting-and-drawing (including upsetting and drawing) is finished, it's returned to the furnace to be re-burnt to reach the required initial forging temperature for upsetting-and-drawing. Preferably, the conditions of returning to furnace and re-burning after each upsetting-and-drawing include that the temperature is 1130-1150° C., and the time is 90-120 minutes, and the returning condition after the final upsetting-and-drawing can adopt the condition of the returning to the furnace, the pass deformation is 310%, the pass reduction is 70 mm, the pass heating temperature is 1140° C., and the pass deformation method is ellipse-ellipse-circle.

In the above manufacturing method, as a preferred embodiment, in the forging process, the radial forging is performed after the completion of the upsetting-and-drawing, and the initial forging temperature of the radial forging is the temperature of the steel after returning to the furnace to reheat. Preferably, the conditions of the radial forging include that the initial forging temperature is 1120-1140° C., the final forging temperature is 800-900° C. and the time is 5-20 minutes. Still preferably, the conditions of the radial forging include: the initial forging temperature is 1000-1100° C., the final forging temperature is 800-900° C., and the time is 10-20 minutes; still preferably, the radial forging is performed on a 1600-ton radial forging machine, one-pass forging is performed, and the radial forged steel is air-cooled.

The low-carbon high-strength nitrogen-containing austenitic stainless steel prepared by the method of the present invention can be used for preparing a steel bar with a diameter of more than 200 mm. The tensile strength at the high temperature of 350° C. of the obtained low-carbon high-strength nitrogen-containing austenitic stainless steel is more than or equal to 410 MPa, the yield strength at the high temperature of 350° C. is more than or equal to 140 MPa, the tensile strength at the room temperature is more than or equal to 560 MPa, the yield strength at the room temperature is more than or equal to 260 MPa, the chemical composition and microstructure are uniform, and the purity of the steel is high.

The present invention will be described in detail below by way of examples.

In the examples, the tensile strength Rm, the yield strength Rp0.2, the elongation after fracture A, and the reduction of area Z are measured by the methods described in RCCM M1000.

Example 1

The embodiment provides a method for manufacturing a low-carbon high-strength nitrogen-containing austenitic stainless steel bar, which sequentially comprises the following steps of: smelting, electroslag remelting and forging. In particular, Smelting Process:

(1) Batching: low carbon ferrochrome, metal nickel, electrolytic manganese, ferrosilicon, nitrided ferrochrome and scrap steel are batched in the way that the steel ingot prepared contains C: 0.026%, Si: 0.54%, Mn: 1.45%, S: less than or equal to 0.002%, P: 0.017%, Cr: 19.7%, Ni: 9.7%, Cu: less than or equal to 1.00%, Co: less than or equal to 0.06%, N: 0.072%, B: less than or equal to 0.0018%, Nb+Ta: less than or equal to 0.15%, wherein ⅓ of the weight of the low-carbon ferrochrome and the nitrided ferrochrome are reserved respectively.

(2) Melting treatment: adding the steelmaking raw materials obtained after proportioning (batching) into an electric arc furnace for melting treatment, firstly inserting an electrode into an alloy material for feeding the material, simultaneously inserting an oxygen lance into the furnace bottom for blowing oxygen for fluxing (to assist melting), adding lime onto the surface of the steelmaking raw materials, and melting and mixing the steelmaking raw materials through electrode heating, oxygen blowing and slag adding. When tapping from the electric furnace, C is 0.56 wt % and tapping temperature is 1690° C.

(3) Refining treatment: pouring molten steel melted by an electric furnace into a out-of-furnace refining furnace, adding 15 kg of Si—C powder and 400 kg of synthetic slag, electrically burning the slag for 15 minutes, taking a sample after power failure for full analysis, returning the sample to adjust the composition (namely, a first sample adjustment treatment). Tapping condition T is 1670° C. In discharge composition, C is 0.40%, Si is 0.25%, and S is 0.005%.

(4) Oxygen blowing decarburization treatment, degassing treatment and nitrogen blowing treatment, the second sample adjustment treatment and casting molding:

Pouring the molten steel after refining treatment and tapping into a vacuum oxygen blowing decarburization furnace for oxygen blowing treatment under vacuum, sampling after oxygen blowing until the carbon content in the steel is 0.005%, then pouring 400 kg of lime, 80 kg of fluorite and 200 kg of synthetic slag into the molten steel, adding 20 kg of deoxidizer Al particles and 20 kg of Ca—Si along with slag materials, and degassing at the vacuum degree of 67 Pa and the retention time of 15 minutes.

And blowing nitrogen into the molten steel after degassing is finished, then adding reserved low-carbon ferrochromium and manganese metal, blowing argon into the molten steel for 20 minutes after the metal materials are melted, and then casting 2.5 tons of electrode molds with the diameter of 410 mm under argon protection. Blowing argon gas at the bottom of the furnace for 20 minutes before casting, and then casting under the protection of argon gas, wherein the casting temperature is 1530-1550° C., and leaving 400 kg of residual casting after casting.

Cutting Treatment and Surface Polishing Treatment:

Cut off the filling part of the steel ingot obtained in the smelting process, and polish the surface of the steel ingot.

Electroslag Remelting Process:

Remelting is performed by using the polished steel ingot as an electrode bar of an electroslag furnace, wherein the weight of slag in the remelting process is 130 kg, and the slag proportion is as follows: $CaF_2$: $Al_2O_3$:CaO:MgO=65%: 20%:10%:5%, remelting current is 11 KA, and remelting voltage is 45V. The molten steel drops into a crystallizer having a diameter of 510 mm (Φ510 mm) to be crystallized, and when 360 kg of the electrode bar remained, it is used as a feeding material for the steel ingot in the mold to feed the shrinkage cavity of the steel ingot.

After the smelting is finished, demould the steel ingot and cool to room temperature to obtain D510 mm steel ingot.

Forging process: Forging process is carried out in a specific forging method, including soaking treatment and forging, wherein the forging comprises upsetting-and-drawing and radial forging, and the specific forging method comprises that the pass deformation is 31%, the pass reduction is 70 mm, the pass heating temperature is 1140° C., and the pass deformation method is ellipse-ellipse-circle. In particular, Soaking treatment: The air-cooled steel ingot of 2.5 tons (Φ510 mm) is subjected to soaking treatment, the condition of soaking is as follows. Firstly, heat the air-cooled steel ingot up to 1150° C. at the heating speed of 2.3° C./min, and then preserve the heat for 4 hours.

Upsetting-and-drawing (including upsetting and drawing) and radial forging: The steel ingot after the soaking treatment is fed into a 4500t press for first upsetting-and-drawing for 8 minutes, the final forging temperature is 850° C. until the diameter is 530 mm, the reduction is 70 mm, and the deformation mode is Φ540 mm ellipse-Φ535 mm ellipse-Φ530 mm circle (the ellipse herein is also called a rough circle in the production process, namely an irregular circle, and the diameter refers to the average value of the major diameter and the minor diameter); then the blank is returned to the furnace for heating at 1140° C. for 90 minutes, and then sent into a press of 4500t for second upsetting-and-drawing for 10 minutes, wherein the final forging temperature is 850° C. until the diameter is 510 mm, the reduction is 70 mm, and the deformation method is Φ520 mm ellipse-Φ515 mm ellipse-Φ510 mm circle; then the steel is returned to the furnace and heated at 1140° C. for 90 minutes and fed into a press of 4500t for first drawing for 15 minutes until the diameter is 420 mm, wherein the reduction is 70 mm, the deformation is 31%, and the deformation mode is Φ430 mm ellipse-Φ425 mm ellipse-Φ420 mm circle; then the steel is returned to the furnace and heated at 1140° C. for 90 minutes, and sent into a press of 4500t for the second drawing for 15 minutes until the diameter is 350 mm, wherein the reduction is 70 mm, the deformation is 31%, and the deformation mode is Φ360 mm ellipse-Φ355 mm ellipse-Φ350 mm circle; then the steel is returned to the furnace and heated for 90 minutes at 1140° C., and then is forged for 20 minutes in a 1600t radial forging machine for one fire time, wherein the final forging temperature is 850° C., the diameter after forging is 200 mm; and then the steel is air-cooled to room temperature to obtain the 00Cr19Ni10N steel bar with the diameter of 200 mm, wherein the tensile strength at 350° C., yield strength at 350° C., tensile strength at room temperature and yield strength at room temperature all meet the requirements of the RCCMM3306 standard, and the chemical composition and microstructure are uniform, and the purity of steel products is high, which are shown in Tables 1 and 2.

TABLE 1

Properties and structure of the low-carbon nitrogen-containing austenitic stainless steel bar obtained in Example 1

| Specification (mm) | Tensile strength at high temperature of 350° C. (MPa) | Yield strength at high temperature of 350° C. (MPa) | Tensile strength at room temperature (MPa) | Yield strength at room temperature (MPa) | Non-metal inclusions | Grain size | Macro-structure |
|---|---|---|---|---|---|---|---|
| Φ200 | 424 | 144 | 568 | 262 | A, B, C, D all the types of inclusion are is less than or equal to grade 0.5 | Uniform grade 5 grain size | Uniform and no segregation |

TABLE 2

Chemical composition (wt %) of the low-carbon nitrogen-containing austeniticstainless steel bar prepared in Example 1

| C | Si | Mn | P | S | Cr | Ni | N | Nb + Ta | Co | Cu | B |
|---|---|---|---|---|---|---|---|---|---|---|---|
| 0.026 | 0.54 | 1.45 | 0.017 | 0.002 | 19.7 | 9.7 | 0.072 | 0.008 | 0.03 | 0.2 | 0.0009 |

Example 2

The embodiment provides a method for manufacturing a low-carbon and high-strength nitrogen-containing austenitic stainless steel bar, which sequentially comprises the following steps of: smelting, electroslag remelting and forging. Wherein, except the material preparation step in the smelting procedure adopts the following technical scheme, the other steps of the smelting process and the electroslag remelting and forging process adopt the technical scheme in Example 1.

Smelting Process:

(1) Batching: Low carbon ferrochrome, metal nickel, electrolytic manganese, ferrosilicon, nitrided ferrochrome and scrap steel are batched in the way that the steel ingot prepared contains C: 0.026%, Si: 0.54%, Mn: 1.45%, S: less than or equal to 0.002%, P: less than or equal to 0.017%, Cr: 190.2%, Ni: 9.2%, Cu: less than or equal to 1.00%, Co: less than or equal to 0.06%, N: 0.072%, B: less than or equal to 0.0018%, and Nb+Ta: less than or equal to 0.15%, wherein ⅓ of the weight of the low-carbon ferrochrome and the nitrided ferrochrome are reserved respectively.

The above batching are adopted for smelting, electroslag remelting and forging, the diameter is 200 mm through final forging, then the steel bar is air-cooled to room temperature, and the 00Cr19Ni10N steel bar with the diameter of 200 mm is obtained, and the tensile strength at the high temperature of 350° C., the yield strength at the high temperature of 350° C., the tensile strength at the room temperature and the yield strength at the room temperature all can not meet the requirements of the RCCMM3306 standard, and are specifically shown in Tables 3 and 4.

TABLE 3

Properties and structure of the low-carbon nitrogen-containing austenitic stainless steel bar prepared in Example 2

| Specification (mm) | Tensile strength at high temperature of 350° C. (MPa) | Yield strength at high temperature of 350° C. (MPa) | Tensile strength at room temperature (MPa) | Yield strength at room temperature (MPa) | Non-metal inclusions | Grain size | Macro-structure |
|---|---|---|---|---|---|---|---|
| Φ200 | 420 | 140 | 558 | 258 | A, B, C, D all the types of inclusion are is less than or equal to grade 0.5 | Uniform grade 5 grain size | Uniform and no segregation |

TABLE 4

Chemical composition (wt %) of the low-carbon nitrogen-containing austenitic stainless steel bar prepared in Example 2

| C | Si | Mn | P | S | Cr | Ni | N | Nb + Ta | Co | Cu | B |
|---|---|---|---|---|---|---|---|---|---|---|---|
| 0.026 | 0.54 | 1.45 | 0.017 | 0.002 | 19.2 | 9.2 | 0.072 | 0.008 | 0.03 | 0.2 | 0.0009 |

Example 3

The embodiment provides a method for manufacturing a low-carbon high-strength nitrogen-containing austenitic stainless steel bar, which sequentially comprises the following steps of smelting, electroslag remelting and forging. Wherein the smelting and electroslag remelting process adopts the same technical scheme as that of Example 2, and the forging process adopts the following technical scheme.

Forging process: Forging process is carried out in a specific forging method, including soaking treatment and forging, wherein the forging method comprises upsetting-and-drawing and radial forging, and the specific forging method comprises that the pass deformation is 31%, the pass reduction is 65 mm, the pass heating temperature is 1140° C., and the pass deformation method is ellipse-ellipse-circle. The reduction herein is the single reduction height of the press, and the deformation is the change in the area of the steel before and after the press. Specifically, Soaking treatment:The steel ingot of 2.5 tons (Φ510 mm) after the air cooling is soaked, and the conditions of soaking are firstly heating up to 1150° C. at the heating speed of 2.3° C./min and then preserving the heat for 4 hours.

Upsetting-and-drawing and radial forging: The steel ingot after the soaking treatment is fed into a 4500t press for first upsetting-and-drawing for 15 minutes, wherein the final forging temperature is 800° C., the diameter is 530 mm, the reduction is 65 mm, and the deformation method is Φ540 mm ellipse-Φ535 mm ellipse-Φ530 mm circle; then the steel ingot is returned to the furnace to heat for 90 minutes at 1130° C., and then fed into a press of 4500t for the second upsetting-and-drawing for 15 minutes, wherein the final forging temperature is 800° C., the diameter is 510 mm, the reduction is 65 mm, and the deformation method is Φ520 mm ellipse-Φ515 mm ellipse-Φ510 mm circle; then the steel ingot is returned to the furnace to heat for 90 minutes at 1130° C., and then fed into a press of 4500t for first drawing for 15 minutes until the diameter is 420 mm, the reduction is 65 mm, the deformation is 31%, and the deformation mode is Φ430 mm ellipse-Φ425 mm ellipse-Φ420 mm circle; then the steel ingot is returned to the furnace to heat for 90 minutes at 1130° C., and then fed into a press of 4500t for secondary drawing for 15 minutes until the diameter is 350 mm, wherein the reduction is 65 mm, the deformation is 31%, and the deformation mode is Φ360 mm ellipse-Φ355 mm ellipse-Φ350 mm circle; then the steel ingot is returned to the furnace to heat for 90 minutes at 1140° C., and performed one-shot forging for 20 minutes in a 1600t radial forging machine, wherein the final forging temperature is 850° C., and the diameter after forging is 200 mm; and then the steel ingot is air-cooled to room temperature to obtain the 00Cr19Ni10N steel bar with the diameter of 200 mm.

TABLE 5

Properties and structure of the low-carbon nitrogen-containing austenitic stainless steel bar obtained in Example 3

| Specification (mm) | Tensile strength temperature at high of 350° C. (MPa) | Yield strength at high temperature of 350° C. (MPa) | Tensile strength at room temperature (MPa) | Yield strength at room temperature (MPa) | Non-metal inclusions | Grain size | Macro-structure |
|---|---|---|---|---|---|---|---|
| Φ200 | 426 | 143 | 566 | 264 | A, B, C, D all the types of inclusion are is less than or equal to grade 0.5 | Uniform grade 5 grain size | Uniform and no segregation |

The 350° C. high-temperature tensile strength, 350° C. high-temperature yield strength, room temperature tensile strength and room temperature yield strength of the 00Cr19Ni10N steel bar all meet the requirements of the RCCMM3306 standard, and the steel bar has uniform chemical composition and high-magnification tissues and high purity, as shown in Tables 5 and 6.

TABLE 6

Chemical composition (wt %) of low-carbon nitrogen-containing austenitic stainless steel bar prepared in Example 3

| C | Si | Mn | P | S | Cr | Ni | N | Nb + Ta | Co | Cu | B |
|---|---|---|---|---|---|---|---|---|---|---|---|
| 0.026 | 0.54 | 1.45 | 0.017 | 0.002 | 19.2 | 9.2 | 0.072 | 0.008 | 0.03 | 0.2 | 0.0009 |

Comparative Example 1

The comparative example provides a method for manufacturing the low-carbon high-strength nitrogen-containing austenitic stainless steel bar by adopting a conventional electroslag process, which sequentially comprises the following steps: smelting, electroslag remelting and forging. The smelting and forging process adopts the same technical scheme as the smelting and forging process in Example 1, and the electroslag remelting process adopts the following technical scheme.

Electroslag Remelting Process:

The steel ingot with the polished surface as an electrode bar of an electroslag furnace is remelted, wherein the weight of slag in the remelting process is 130 kg, and the slag ratio is: $CaF_2$: $Al_2O_3$=70%: 30%, remelting current is 12 KA, and remelting voltage is 45V; the molten steel drops into a crystallizer with the diameter of 510 mm for crystallizing, and when 360 kg of the electrode bar left, it is used as a feeding material of the steel ingot in the crystallizer to perform feeding treatment on the shrinkage cavity of the steel ingot.

The steel ingot is demolded after the smelting is finished and cooled to room temperature.

Then, the steel ingot obtained in the electroslag remelting process is forged to obtain a steel bar with the diameter of 200 mm, and then the steel bar is air-cooled to room temperature to obtain a 00Cr19Ni10N steel bar with the diameter of 200 mm, wherein the tensile strength at the high temperature of 350° C., the yield strength at the high temperature of 350° C., the tensile strength at the room temperature and the yield strength at the room temperature all can not meet the requirements of the RCCMM3306 standard, the purity of the steel is low, and the macrostructure is uneven, which is specifically shown in Tables 7 and 8.

TABLE 7

Properties and structure of the low-carbon nitrogen-containing austenitic stainless steel bar obtained in Comparative example

| Specification (mm) | Tensile strength at high temperature of 350° C. (MPa) | Yield strength at high temperature of 350° C. (MPa) | Tensile strength at room temperature (MPa) | Yield strength at room temperature (MPa) | Non-metal inclusions | Grain size | Macro-structure |
|---|---|---|---|---|---|---|---|
| Φ200 | 390 | 113 | 533 | 232 | A, B, C, D all the types of inclusion are grade 1.5 | Grade 5-4 | Having segregation |

TABLE 8

Chemical composition (wt %) of the low-carbon nitrogen-containing austenitic stainless steel bar prepared in Comparative example 1

| C | Si | Mn | P | S | Cr | Ni | N | Nb + Ta | Co | Cu | B |
|---|---|---|---|---|---|---|---|---|---|---|---|
| 0.026 | 0.54 | 1.45 | 0.017 | 0.002 | 19.7 | 9.6 | 0.072 | 0.008 | 0.03 | 0.2 | 0.0009 |

Comparative Example 2

The comparative example provides a method for manufacturing a low-carbon high-strength nitrogen-containing austenitic stainless steel bar produced by adopting a conventional forging process, which sequentially comprises the following steps: smelting, electroslag remelting and forging. The smelting and electroslag remelting process adopts the same technical scheme as that of Example 1, and the forging process adopts the following technical scheme.

Forging: Forging in a specific forging method, including soaking treatment and forging, wherein the forging method comprises upsetting-and-drawing and radial forging, and the specific forging method comprises: the pass deformation is 50%, the pass reduction is 120 mm, the pass heating temperature is 1170° C., and the pass deformation method is square-ellipse-circle. In particular, Soaking treatment:The steel ingot of 2.5 tons (Φ510 mm) after the air cooling is soaked, and the conditions of soaking are firstly heating up to 1170° C. at the heating speed of 2.3° C./min and preserving heat for 4 hours.

Upsetting-and-drawing and radial forging: the steel ingot after the soaking treatment is fed into a 4500t press for first upsetting-and-drawing for 8 minutes, wherein the final forging temperature is 850° C. until the diameter is 530 mm, the reduction is 120 mm, and the deformation method is 530 mm square-Φ535 mm ellipse-Φ530 mm circle; then the blank is returned to the furnace and heated at 1170° C. for 90 minutes, and then fed into a press of 4500t for second upsetting-and-drawing for 10 minutes, wherein the final forging temperature is 750° C., the diameter is 450 mm, the reduction is 120 mm, and the deformation method is 440 mm-square-billet-Φ455 mm-ellipse-Φ450 mm-circle; then the steel is returned to the furnace and heated at 1170° C. for 90 minutes, and then fed into a press of 4500t for drawing for 15 minutes until the diameter is 300 mm, wherein the reduction is 120 mm, the deformation is 55%, and the deformation method is 310 mm-square-billet-Φ305 mm-ellipse-Φ300 mm-circle; then the steel is returned to the furnace and heated again at 1170° C. for 90 minutes, then performed one-fire forging for 20 minutes in a 1600t radial forging machine, wherein the final forging temperature is 850° C., the diameter after forging is 200 mm; then the steel is air-cooled to room temperature to obtain a 200 mm diameter 00Cr19Ni10N steel bar. The 350° C. high temperature tensile strength, the 350° C. high temperature yield strength, the room temperature tensile strength and the room temperature yield strength of the steel bar can not meet the requirements of the RCCMM3306 standard, and the high-magnification structure (microstructure) and the low-magnification structure (macrostructure) are not uniform, which is shown in Tables 9 and 10.

TABLE 9

Properties and structure of the low-carbon nitrogen-containing austenitic stainless steel bar obtained in Comparative Example 2

| Specification (mm) | Tensile strength at high temperature of 350° C. (MPa) | Yield strength at high temperature of 350° C. (MPa) | Tensile strength at room temperature (MPa) | Yield strength at room temperature (MPa) | Non-metal inclusions | Grain size | Macro-structure |
|---|---|---|---|---|---|---|---|
| Φ200 | 385 | 121 | 527 | 210 | A, B, C, D all the types of inclusion are is less than or equal to Grade 0.5 | Grades 5-2 mixed crystal | Non-uniform tissue |

TABLE 10

Chemical composition (wt %) of low-carbon nitrogen-containing austenitic stainless steel bar prepared in Comparative Example 2

| C | Si | Mn | P | S | Cr | Ni | N | Nb + Ta | Co | Cu | B |
|---|---|---|---|---|---|---|---|---|---|---|---|
| 0.026 | 0.54 | 1.45 | 0.017 | 0.002 | 19.7 | 9.6 | 0.072 | 0.008 | 0.03 | 0.2 | 0.0009 |

Comparative Example 3

The comparative example provides a method for manufacturing a low-carbon high-strength nitrogen-containing austenitic stainless steel bar produced in a conventional chemical component control range, which sequentially comprises the following steps: smelting, electroslag remelting and forging. Wherein, except the material preparation step in the smelting procedure adopts the following technical scheme, the other steps of the smelting process, the electroslag remelting process and the forging process all adopt the technical scheme in Example 1. In particular, Smelting Process:

(1) Batching: Low carbon ferrochrome, metal nickel, electrolytic manganese, ferrosilicon, nitrided ferrochrome and scrap steel are batched in the way that the steel ingot prepared contains C: 0.026%, Si: 0.54%, Mn: 1.45%, S: less than or equal to 0.002%, P: less than or equal to 0.017%, Cr: 18.8%, Ni: 9.3%, Cu: less than or equal to 1.00%, Co: less than or equal to 0.06%, N: 0.05%, B: less than or equal to 0.0018%, Nb+Ta: less than or equal to 0.15%, wherein ⅓ of the weight of the low-carbon ferrochrome and the weight of the nitrided ferrochrome are reserved respectively.

The above ingredients are adopted for smelting, electroslag remelting and forging, the diameter is 200 mm after final forging; and then, 200 mm-diameter 00Cr19Ni10N steel bar is obtained though air-cooling to room temperature. The tensile strength at the high temperature of 350° C., the yield strength at the high temperature of 350° C., the tensile strength at the room temperature and the yield strength at the room temperature of the steel bar all can not meet the requirements of the RCCMM3306 standard, which are specifically shown in Tables 11 and 12.

TABLE 11

Properties and structure of the low-carbon nitrogen-containing austenitic stainless steel bar obtained in Comparative Example 3

| Specification (mm) | Tensile strength at high temperature of 350° C. (MPa) | Yield strength at high temperature of 350° C. (MPa) | Tensile strength at room temperature (MPa) | Yield strength at room temperature (MPa) | Non-metal inclusions | Grain size | Macro-structure |
|---|---|---|---|---|---|---|---|
| Φ200 | 370 | 109 | 518 | 202 | A, B, C, D all the types of inclusion are less than or equal to Grade 0.5 | Uniform Grade 5 grain size | Uniform and no segregation |

TABLE 12

Chemical composition (wt %) of low-carbon nitrogen-containing austenitic stainless steel bar prepared in Comparative Example 3

| C | Si | Mn | P | S | Cr | Ni | N | Nb + Ta | Co | Cu | B |
|---|---|---|---|---|---|---|---|---|---|---|---|
| 0.026 | 0.54 | 1.45 | 0.017 | 0.002 | 18.8 | 9.3 | 0.05 | 0.008 | 0.03 | 0.2 | 0.0009 |

In conclusion, by adopting the technical scheme of the invention, the low-carbon high-strength nitrogen-containing austenitic stainless steel with uniformly distributed chemical composition and tissues, high purity and high strength can be obtained.

The invention claimed is:

1. A method for manufacturing a low-carbon, nitrogen-containing austenitic stainless steel bar, comprising, sequentially:

smelting to obtain a steel ingot;

electroslag remelting of the steel ingot obtained by said smelting with a specific slag comprising $CaF_2$, $Al_2O_3$, CaO, and MgO in weight percentages of 65%-68%, 18%-20%, 5%-10% and 3%-5%, respectively, to obtain a crystallized steel ingot; and forging, including first performing a soaking treatment on the crystallized steel ingot including heating the crystallized steel ingot to 1130-1150° C. at a rate of 1-10° C. per minute, followed by upsetting-and-drawing and radial forging, the upsetting-and-drawing comprising two to three repetitions with a pass deformation of less than 35%, a pass reduction of 50-80 mm, a pass heating temperature of 1130-1150° C., a pass deformation method of ellipse-ellipse-circle, an initial forging temperature of greater than or equal to 1000° C., and a final forging temperature of greater than or equal to 800° C., and the radial forging occurring after the upsetting-and-drawing with an initial forging temperature of 1000-1140° C. and a final forging temperature of 800-900° C.; and air cooling the radial-forged steel to obtain the stainless steel bar, the stainless steel bar having a diameter of 200 mm;

wherein: a composition of the steel ingot obtained by said smelting or a composition of the stainless steel bar, comprises C: 0.020-0.030%, Si: 0.3-0.6%, Mn: 1.3-1.8%, S: less than or equal to 0.002%, P: less than or equal to 0.015%, Cr: 19.20-19.70%, Ni: 9.20-9.80%, Cu: less than or equal to 1.00%, Co: less than or equal to 0.06%, N: 0.065-0.075%, B: less than or equal to 0.0018%, and Nb+Ta: less than or equal to 0.15%, each in percentage by weight.

2. The method of claim 1, wherein the specific slag comprises $CaF_2$, $Al_2O_3$, CaO and MgO in weight percentages of 65%, 20%, 10%, and 5%, respectively.

3. The method of claim 1, wherein the composition of the steel ingot obtained by said smelting, or the composition of the stainless steel bar, comprises C: 0.025%, Si: 0.5%, Mn: 1.45%, S: less than or equal to 0.002%, P: less than or equal to 0.015%, Cr: 19.5%, Ni: 9.7%, Cu: less than or equal to 1.00%, Co: less than or equal to 0.06%, N: 0.07%, B: less than or equal to 0.0018%, and Nb+Ta: less than or equal to 0.15%, each in percentage by weight.

4. The method of claim 1, wherein said smelting sequentially comprises melting, refining, vacuum degassing, and casting molding.

5. The method of claim 1, further comprising, before said electroslag remelting, cutting and surface-polishing the steel ingot obtained by said smelting to obtain an electrode bar for said electroslag remelting.

6. The method of claim 5, wherein in said electroslag remelting, 1-10 wt % of the electrode bar is used for feeding the crystallized steel ingot.

7. The method of claim 6, wherein in said electroslag remelting, 1-8 wt % of the electrode bar is used for feeding the crystallized steel ingot.

8. The method of claim 1, wherein in said electroslag remelting, an applied current is 11-13 KA.

9. The method of claim 1, wherein during the soaking treatment, 1130-1150° C. is held for 3-5 hours.

10. The method of claim 1, wherein during said forging, each of the two to three repetitions of the upsetting-and-drawing comprises 5-20 minutes.

11. The method of claim 10, wherein during said forging, each of the two to three repetitions of the upsetting-and-drawing comprises 5-15 minutes, the initial forging temperature is 1050-1100° C., the pass deformation is 30-32%, and the pass reduction is 65-75 mm.

12. The method of claim 1, further comprising, after each of the two to three repetitions of the upsetting-and-drawing, returning the forged steel to the furnace for 90-120 minutes so as to reach the pass heating temperature for a next of the two to three repetitions.

13. The method of claim 1, wherein the radial forging comprises radial forging for 5-20 minutes.

14. The method of claim 13, wherein the radial forging is performed at an initial forging temperature of 1000-1100° C. and a final forging temperature of 800-900° C. for 10-20 minutes using a 1600-ton radial forging machine.

15. The method of claim 1, wherein the stainless steel bar has a tensile strength at 350° C. of greater than or equal to 410 MPa, a yield strength at 350° C. of greater than or equal to 140 MPa, a tensile strength at room temperature of greater than or equal to 560 MPa, and a yield strength at room temperature of greater than or equal to 260 MPa.

* * * * *